US006992540B2

(12) United States Patent
Hino

(10) Patent No.: US 6,992,540 B2
(45) Date of Patent: Jan. 31, 2006

(54) TWO-PORT ISOLATOR AND COMMUNICATION DEVICE

(75) Inventor: Seigo Hino, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 98 days.

(21) Appl. No.: 10/817,816

(22) Filed: Apr. 6, 2004

(65) Prior Publication Data

US 2004/0263278 A1 Dec. 30, 2004

(30) Foreign Application Priority Data

Jun. 24, 2003 (JP) ..... 2003-180027

(51) Int. Cl.
*H01P 1/36* (2006.01)

(52) U.S. Cl. ..... 333/24.2; 333/1.1

(58) Field of Classification Search ..... 333/24.2, 333/1.1

See application file for complete search history.

(56) References Cited

FOREIGN PATENT DOCUMENTS

| | | |
|---|---|---|
| JP | 57-007615 | 1/1982 |
| JP | 09-232818 | 9/1997 |
| JP | 2001-267872 | 9/2001 |
| JP | 2002-305125 | 10/2002 |
| JP | 2003-128456 | 5/2003 |

*Primary Examiner*—Stephen E. Jones
(74) *Attorney, Agent, or Firm*—Keating & Bennett, LLP

(57) ABSTRACT

A two-port isolator includes a microwave ferrite member, first and second center electrodes that intersect with each other on the ferrite member with isolation therebetween, a permanent magnet that applies a DC magnetic field to the ferrite member, and a multilayer substrate having center-electrode-connecting electrodes and first and second matching capacitors. The ferrite member, the first and second center electrodes, the permanent magnet, and the multilayer substrate are accommodated in a housing that includes a magnetic cap and a case having a magnetic metal plate molded thereonto. The second matching capacitor has a higher Q factor than the first matching capacitor.

13 Claims, 10 Drawing Sheets

FIRST LAYER (SURFACE CONNECTED TO CENTER ELECTRODES)

SECOND LAYER

THIRD LAYER

FOURTH LAYER

FIFTH LAYER

SIXTH LAYER (SURFACE CONNECTED TO TERMINALS)

TWO-PORT ISOLATOR AND COMMUNICATION DEVICE

BACKGROUND OF THE INVENTION

1. Field of the Invention

The present invention generally relates to two-port isolators, and, more specifically, to a two-port isolator for use in the microwave band and to a communication device.

2. Description of the Related Art

Generally, non-reciprocal circuit elements, such as isolators and circulators, have a characteristic that permits a signal to transmit only in a predetermined direction but not in the opposite direction. Such circuit elements are used in transmitting circuits of mobile communication devices, such as mobile telephones and cellular telephones. One type of non-reciprocal circuit element is the two-port circuit element disclosed in, for example, Japanese Unexamined Patent Application Publication No. 9-232818. Equivalent circuits of such a circuit element, namely, a two-port isolator, are shown in FIGS. 11 and 17 of this publication.

The isolator shown in FIG. 17 of this publication, which is well known in the art, has a problem in that two resonance circuits are resonated during signal propagation from an input port to an output port, which causes high power loss and high insertion loss.

In the isolator shown in FIG. 11 of the above-cited publication, on the other hand, resonance circuits disposed between an input port and an output port are not resonated during signal propagation from the input port to the output port, and no power loss occurs, thus greatly reducing the insertion loss.

In the two-port isolator shown in FIG. 11 of the above-cited publication, first and second matching capacitors are formed by laminating high-Q dielectric sheets each having an electrode. This is because the Q factor of the matching capacitors must be high in order to suppress the insertion loss.

However, due to the use of a high-purity starting material and a high-precision manufacturing process, high-Q dielectric material increases the production cost of the isolator. Moreover, high-Q dielectric material generally has a relatively low relative dielectric constant, and it is therefore necessary to increase the area of the matching capacitor electrodes or to increase the number of laminated sheets in order to obtain the required matching capacitors. This makes it difficult to reduce the size and cost of the isolator.

In a case where the matching capacitor electrodes are formed in a multilayer substrate, if the area of via holes connected with the matching capacitor electrodes is small, a large conductor loss occurs in the via holes, and high-Q matching capacitors are not obtained. Thus, via holes must be formed so as to be large enough to provide high-Q matching capacitors. However, since at least a certain clearance is required between a via hole and a matching capacitor electrode formed on a dielectric sheet with the via hole therethrough, the larger the via hole, the smaller the matching capacitor electrode. Thus, the required capacitance is not obtained.

SUMMARY OF THE INVENTION

To overcome the problems described above, preferred embodiments of the present invention provide a two-port isolator having low insertion loss and low cost and a communication device including such an isolator, and also provide a two-port isolator that is very compact and a communication device including such an isolator.

A preferred embodiment of the present invention provides a two-port isolator including a permanent magnet, a microwave ferrite to which a DC magnetic field is applied by the permanent magnet, a first center electrode disposed on a principle surface of the microwave ferrite or disposed in the microwave ferrite, having a first end electrically connected with an input port and a second end electrically connected with an output port, a second center electrode disposed on the principle surface of the microwave ferrite or disposed in the microwave ferrite so as to intersect with the first center electrode with electrical isolation therebetween, having a first end electrically connected with the output port and a second end electrically connected with a ground, a first matching capacitor electrically connected between the input port and the output port, a second matching capacitor electrically connected between the output port and the ground, and a resistor electrically connected between the input port and the output port. The second matching capacitor has a Q factor that is greater than the first matching capacitor.

The inventor of the present invention has discovered that the insertion loss of the two-port isolator is more severely affected by the Q factor of the second matching capacitor than by the Q factor of the first matching capacitor. This is because during forward signal propagation from the input port to the output port, the potential is in-phase between input and output terminals, and a forward current does not flow in the first matching capacitor.

In the two-port isolator according to preferred embodiments of the present invention, the Q factor of the second matching capacitor is preferably greater than the Q factor of the first matching capacitor. Thus, the first matching capacitor may be made of an inexpensive low-Q dielectric material.

Specifically, a dielectric used for the second matching capacitor may have a higher Q factor than a dielectric that used for the first matching capacitor. In this case, it is more advantageous in a manufacturing process to form the first and second matching capacitors in a single laminated substrate. Each of the first and second matching capacitors may be formed into a single product as a single-plate capacitor or a laminated capacitor. The dielectric materials of these products may be the same or different, but the electrode configurations differ from each other, thus allowing the Q factor to be different from the first matching capacitor to the second matching capacitor.

In the two-port isolator according to preferred embodiments of the present invention, the first matching capacitor preferably includes a first electrode and a second electrode that face each other with a first dielectric sheet therebetween, and the second electrode and a third electrode that face each other with a second dielectric sheet therebetween, and the second matching capacitor preferably includes the third electrode and a fourth electrode that face each other with a third dielectric sheet therebetween. The third dielectric sheet preferably has a higher Q factor than the first and second dielectric sheets.

Alternatively, the first matching capacitor may include a first electrode and a second electrode that face each other with a first dielectric sheet therebetween, and the second electrode and a third electrode that face each other with a second dielectric sheet therebetween, and the second matching capacitor may include the first electrode and a fourth electrode that face each other with the first dielectric sheet therebetween, the fourth electrode and the third electrode that face each other with the second dielectric sheet therebetween, and the third electrode and a fifth electrode that face each other with a third dielectric sheet therebetween. The first and third dielectric sheets may have a higher Q factor than the second dielectric sheet.

In the two-port isolator according to preferred embodiments of the present invention, furthermore, a via hole connected with the electrodes that define the second matching capacitor are preferably larger than a via hole connected with the electrodes that define the first matching capacitor. The larger the via hole connected with an electrode, the higher the Q factor of the matching capacitor defined by this electrode, which leads to lower insertion loss. The first matching capacitor preferably has a relatively low Q factor, and the via hole connected with the electrodes for the first matching capacitor is preferably small. Thus, the area of the matching capacitor electrode in the dielectric layer with the via hole extending therethrough is increased. In other words, the required matching capacitors are obtained without increasing the number of sheets for the matching capacitor electrodes or increasing the size of the laminated substrate.

Another preferred embodiment of the present invention provides a communication device including the two-port isolator, which is also compact and low-cost.

According to various preferred embodiments of the present invention, therefore, the insertion loss is reduced during signal propagation from the input port to the output port. Moreover, the second matching capacitor preferably has a higher Q factor than the first matching capacitor, and the first matching capacitor is preferably made of an inexpensive material of low Q factor and/or relatively high dielectric constant. Thus, a compact and low-cost isolator in which the insertion loss is slow is realized.

Other features, elements, characteristics and advantages of the present invention will become more apparent from the following detailed description of preferred embodiments with reference to the attached drawings.

DETAILED DESCRIPTION OF PREFERRED EMBODIMENTS

A two-port isolator and a communication device according to preferred embodiments of the present invention will be described with reference to the drawings. Throughout the figures, a shaded portion represents a conductor.

First Preferred Embodiment

Figure 1:
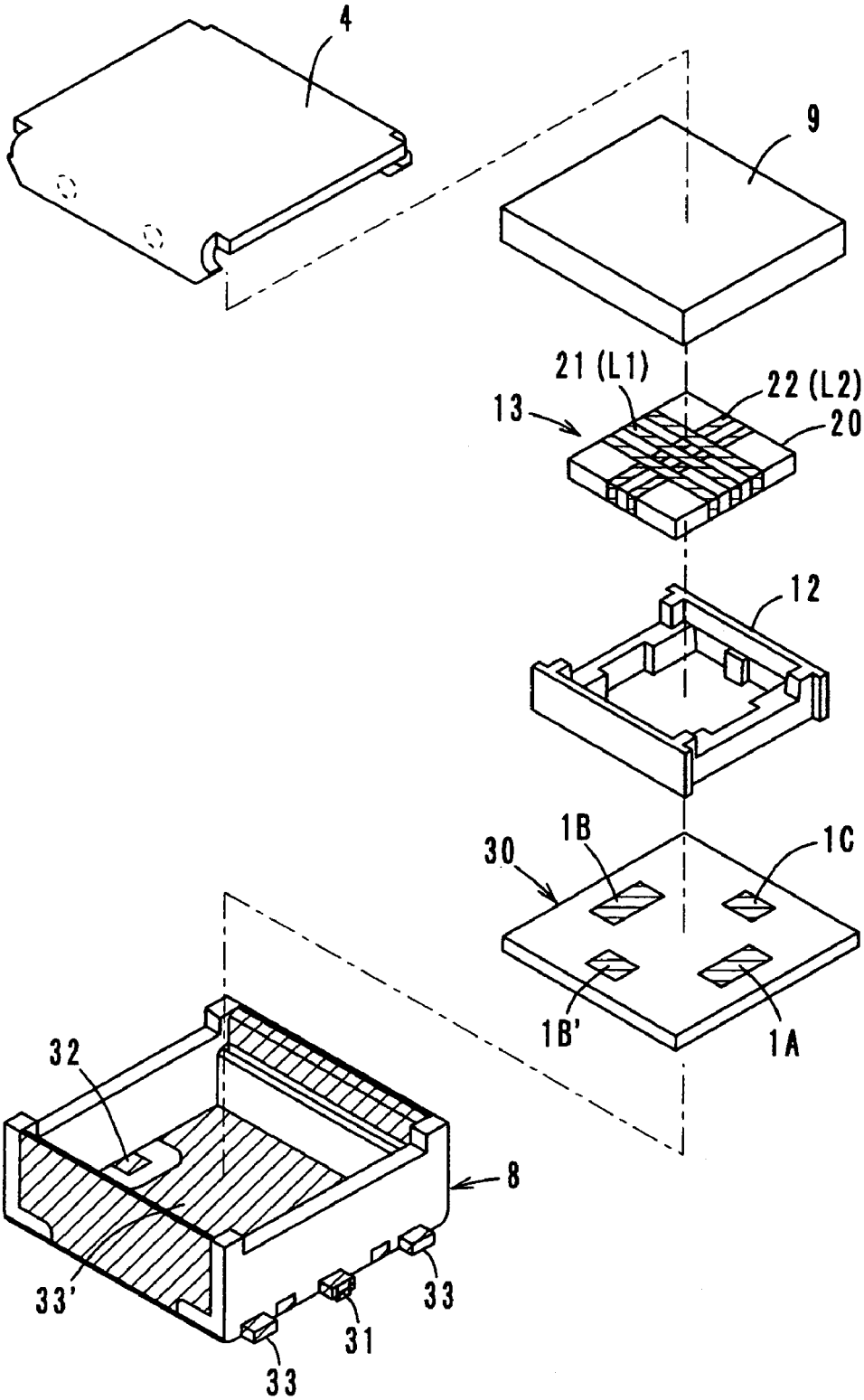
FIG. 1 is an exploded perspective view of a two-port isolator according to a first preferred embodiment of the present invention.
Figure 5:
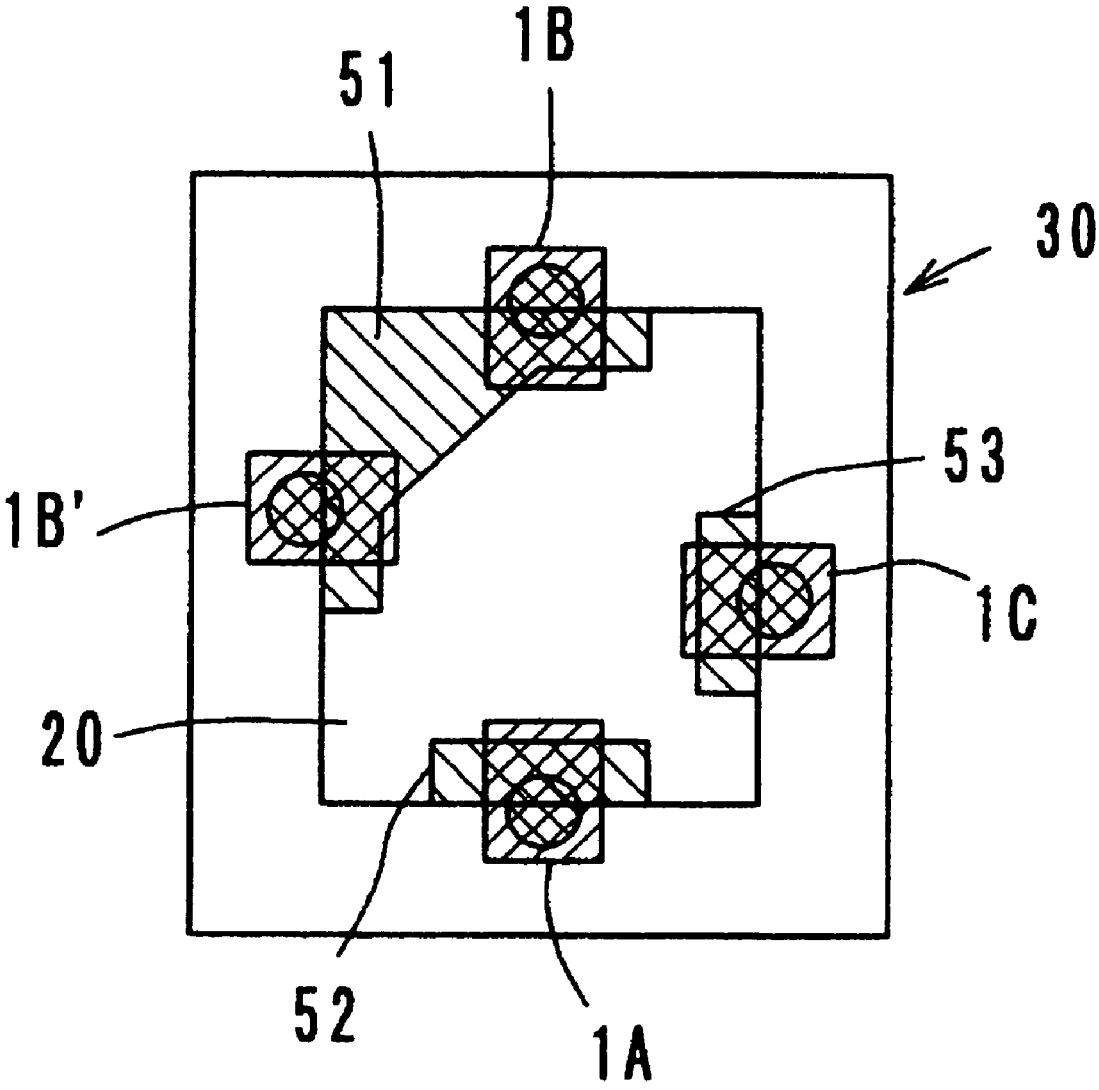
FIG. 5 is a diagram showing that electrodes overlap when the ferrite member is mounted onto the multilayer substrate.
Figure 6:
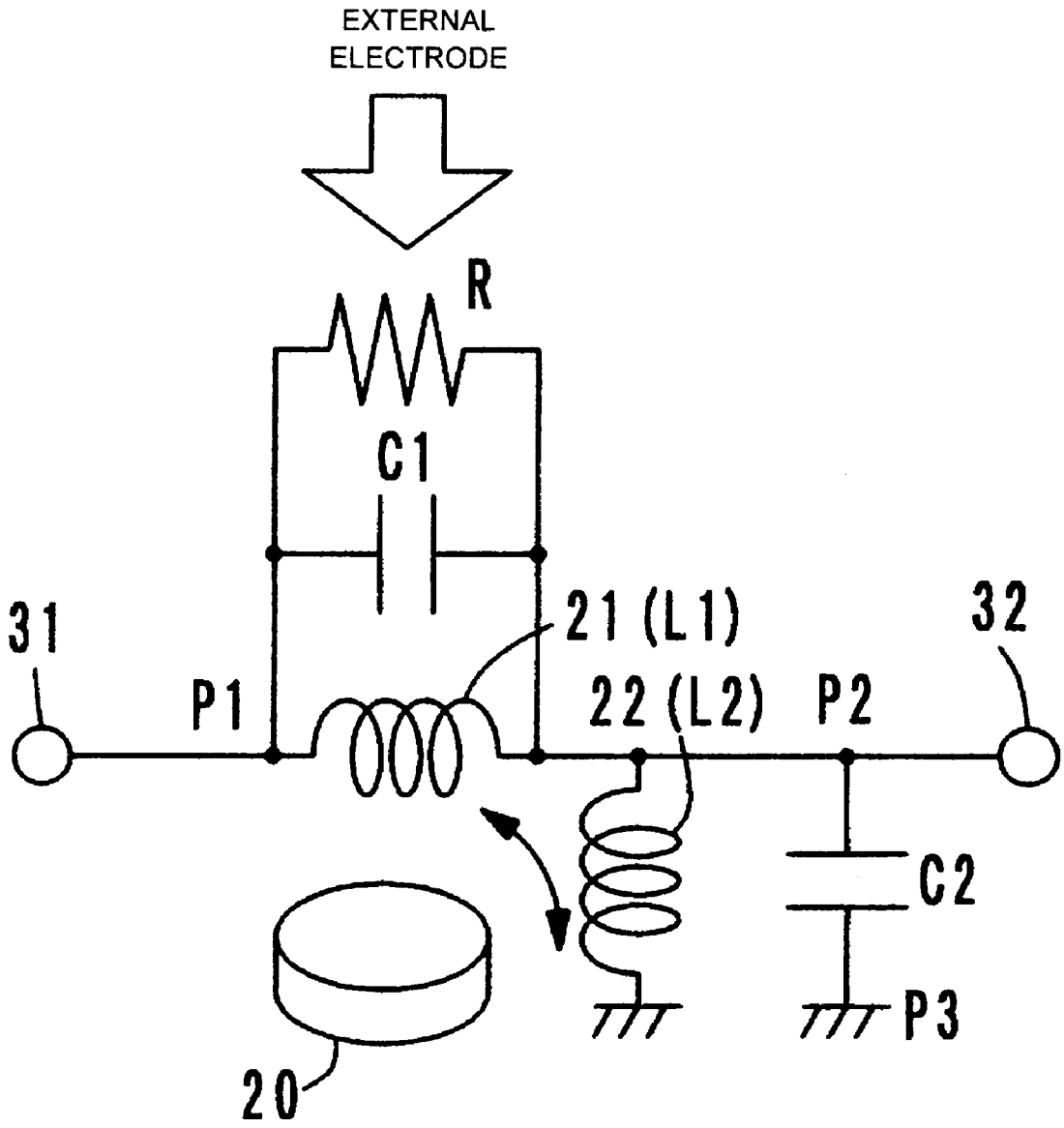
FIG. 6 is an electrical equivalent circuit diagram of the two-port isolator.
Figure 7A:
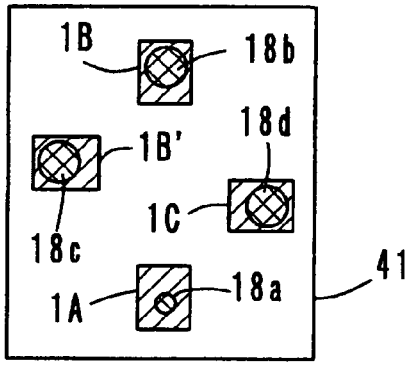
FIGS. 7A to 7F are plan views of layers of a multilayer substrate of a two-port isolator according to a second preferred embodiment of the present invention.
Figure 7B:
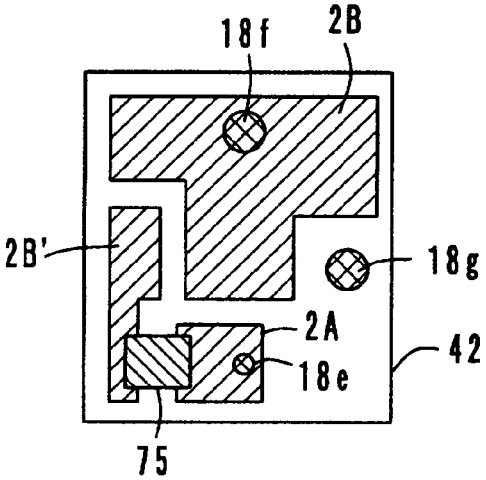
Figure 7C:
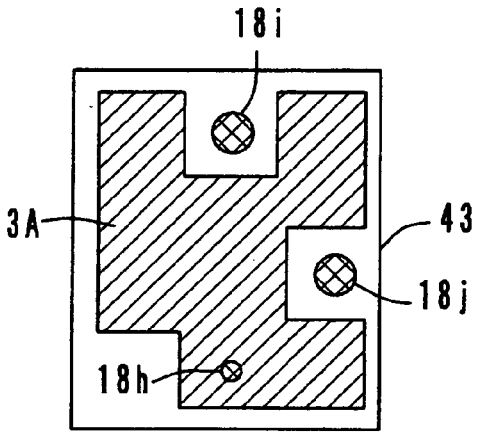
Figure 7D:
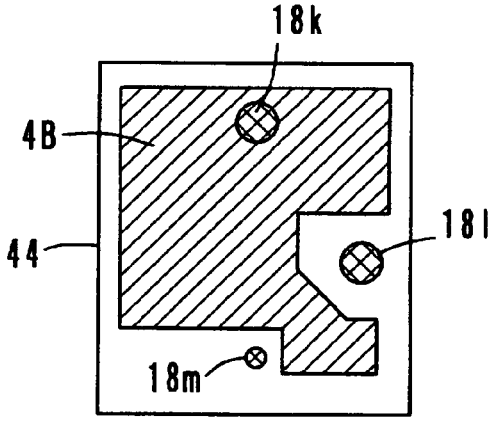
Figure 7E:
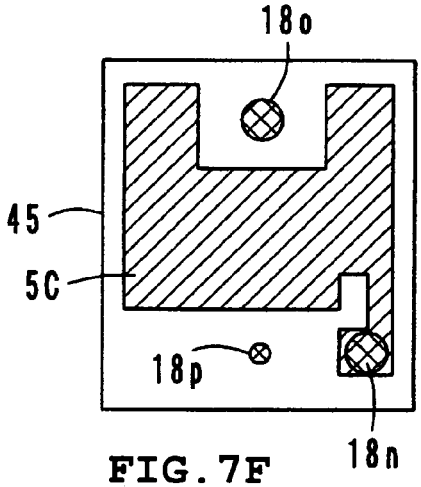
Figure 7F:
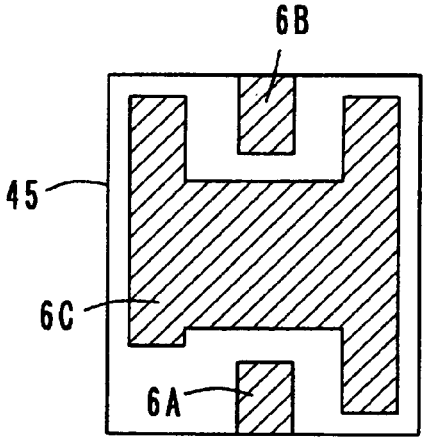

A two-port isolator according to a first preferred embodiment of the present invention will be described with reference to FIGS. 1 to 6. FIG. 1 is an exploded perspective view of the two-port isolator, and FIG. 6 is an equivalent circuit diagram of this isolator. The isolator of the first preferred embodiment is preferably a two-port lumped-constant-type isolator. As shown in FIG. 1, the lumped-constant type isolator includes a metal cap 4, a case 8, a permanent magnet 9, a center electrode assembly 13 having a substantially rectangular microwave ferrite member 20 and first and second center electrodes 21 and 22, a resin frame 12, and a multilayer substrate 30.

The magnet 9, the center electrode assembly 13, the frame 12, and the multilayer substrate 30 are accommodated in a housing that is defined by the cap 4 and the case 8. The cap 4 and a metal plate molded onto the case 8 are made of a ferromagnetic material, for example, soft iron, ferrite, or other suitable ferromagnetic material, and are plated with Ag or Cu, such that the cap 4 and the metal plate define a magnetic circuit.

In the center electrode assembly 13, the first center electrode 21 and the second center electrode 22 intersect with each other with an insulating layer (not shown) therebetween substantially at 90° on the top surface of the rectangular microwave ferrite member 20. In the first preferred embodiment, the first center electrode 21 preferably includes three lines, and the second center electrode 22 preferably includes two lines. Ends of the center electrodes 21 and 22 extend beneath the ferrite member 20 to define electrodes 51, 52, and 53, which are electrically connected with electrodes 1A, 1B, 1B', and 1C provided on the multilayer substrate 30, as described below with reference to FIGS. 4 and 5.

The first and second center electrodes 21 and 22 may be a copper foil wound around the ferrite member 20. Alternatively, the first and second center electrodes 21 and 22 may be printed on or in the ferrite member 20 with silver paste. The center electrodes 21 and 22 formed by printing provide higher positional accuracy, and are thus, more stably connected to the multilayer substrate 30. Particularly, in the first preferred embodiment, in view of higher reliability and processability, it is desirable that the first and second center electrodes 21 and 22, which are to be connected with the small center-electrode-connecting electrodes 1A, 1B, 1B', and 1C, be formed by printing.

As shown in FIGS. 2A to 2F and FIG. 3, the multilayer substrate 30 is a laminate including first to fifth ceramic dielectric sheets 41 to 45. Each of the first to fourth sheets 41 to 44 has a conductor layer on the top surface thereof, and the fifth (bottom) sheet 45 has conductor layers on the top and bottom surfaces thereof.

Figure 2A:
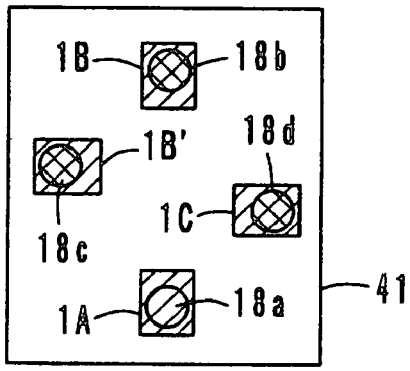
FIGS. 2A to 2F are plan views of layers of a multilayer substrate according to the first preferred embodiment of the present invention.
Figure 2B:
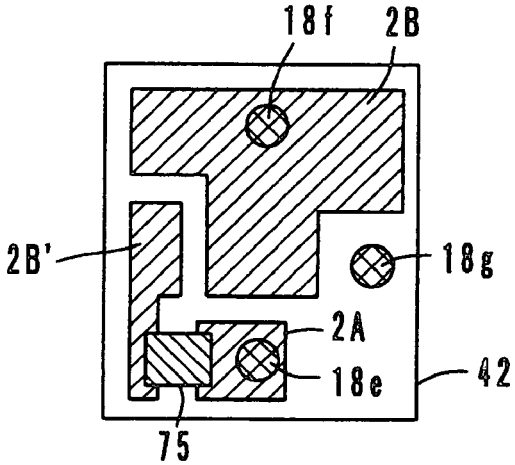

As shown in FIG. 2A, on the surface for connection with the center electrodes 21 and 22, the center-electrode-connecting electrodes 1A, 1B, 1B', and 1C having via holes 18*a*, 18*b*, 18*c*,and 18*d*, respectively, are provided on the first (top) dielectric sheet 41. As shown in FIG. 2B, a resistor film 75 (a terminating resistor R), electrodes 2A and 2B' for connecting the resistor film 75, and a capacitor electrode 2B are provided on the second dielectric sheet 42. Via holes 18*e*, 18*f*, and 18*g* are also provided at predetermined positions on the second dielectric sheet 42.

Figure 2C:
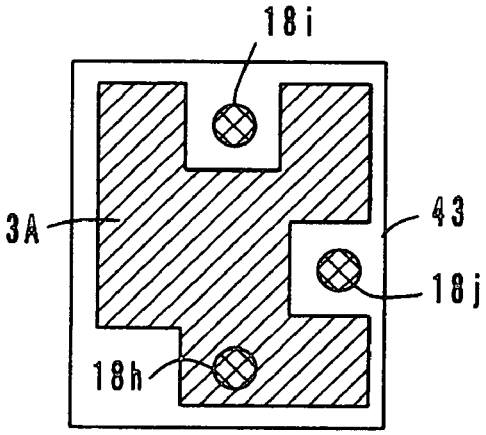
Figure 2D:
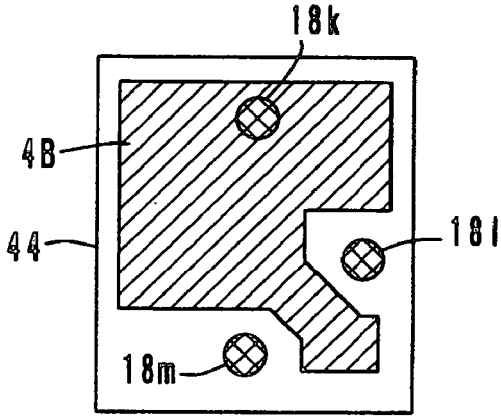

As shown in FIG. 2C, a capacitor electrode 3A is provided on the third dielectric sheet 43, with via holes 18*h*, 18*i*, and 18*j* at predetermined positions. As shown in FIG. 2D, a capacitor electrode 4B is provided on the fourth dielectric sheet 44, with via holes 18*k*, 18*l*, and 18*m* at predetermined positions.

Figure 2E:
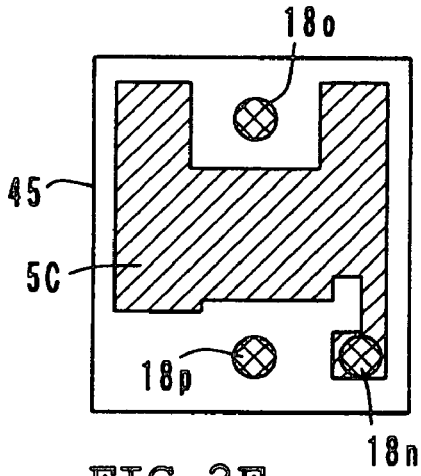
Figure 2F:
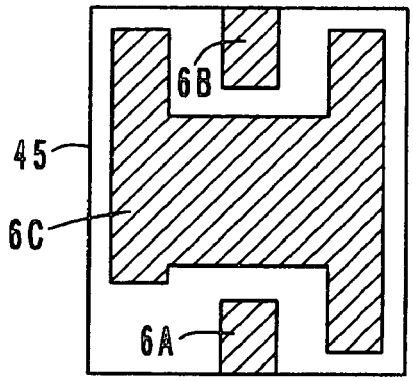
Figure 3:
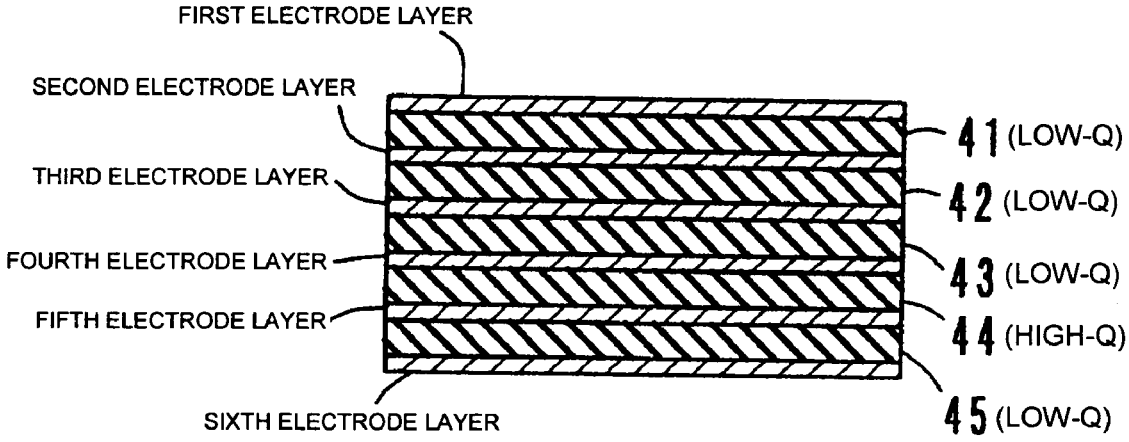
FIG. 3 is a schematic cross-sectional view of the multilayer substrate.

As shown in FIG. 2E, a capacitor electrode 5C is provided on the top surface of the fifth dielectric sheet 45, with via holes 18*n*, 18*o*, and 18*p* at predetermined positions. As shown in FIG. 2F, on the surface for connection with terminals, a ground electrode 6C and terminal-connecting electrodes 6A and 6B are provided on the bottom surface of the dielectric sheet 45.

The electrodes described above are preferably formed on the dielectric sheets 41 to 45 by a technique such as screen printing or other suitable process. The electrodes are preferably made of a low-resistivity material, such as Ag, Cu, or Ag—Pd, or other suitable material, which can be sintered together with the dielectric sheets 41 to 45. The ground electrode 6C and the terminal-connecting electrodes 6A and 6B are first plated with Ni and are then plated with Au. The Ni plating increases the bonding strength between Ag of the electrodes and the Au plating. The Au plating improves the solder wettability, and reduces the insertion loss of the isolator due to its high conductivity.

Each electrode is preferably about 2 $\mu$m to about 20 $\mu$m, for example, in thickness. The dielectric sheets 41 to 45 are made of a sintered dielectric including a plurality of materials, such as CaO, $Al_2O_3$, $SiO_2$, $B_2O_3$, BaO, $Nd_2O_3$, $TiO_2$, and $B_2O_3$, or other suitable material, as required. The dielectric sheets 41 to 45 are preferably about 5 $\mu$m to about 100 $\mu$m in thickness, for example. The specific materials and thicknesses of the dielectric sheets 41 to 45 and the electrodes described above are shown below together with the capacitances of the matching capacitors C1 and C2.

The resistor film 75 is formed on the second dielectric sheet 42 by a technique such as pattern printing. The resistor film 75 is made of cermet, carbon, ruthenium, or other suitable material. The resistor film 75 solely defines a terminating resistor R (see FIG. 6).

Each via hole is formed by filling conductive paste in a via-hole opening that is perforated in advance through each of the dielectric sheets 41 to 45 by laser processing, punching, or other suitable method.

The dielectric sheets 41 to 45 are laminated, and the laminated sheets are concurrently sintered to produce the multilayer substrate 30. In the multilayer substrate 30, the electrode 1A in the first layer is electrically connected with the electrode 2A in the second layer via the via hole 18*a*, and is further connected with the electrode 2B' via the resistor film 75. The electrode 2B' is electrically connected with the electrode 1B' in the first layer via the via hole 18*c*.

The electrode 1A in the first layer is also electrically connected with the capacitor electrode 3A in the third layer through the via holes 18*a* and 18*e*. The capacitor electrode 3A is electrically connected with the terminal-connecting electrode 6A through the via holes 18*h*, 18*m*, and 18*p*.

The electrode 1B in the first layer is electrically connected with the capacitor electrode 2B in the second layer via the via hole 18*b*, and is also electrically connected with the capacitor electrode 4B in the fourth layer via the via holes 18*f* and 18*i*. The capacitor electrode 4B is also electrically connected with the terminal-connecting electrode 6B through the via holes 18*k* and 18*o*.

The electrode 1C in the first layer is electrically connected with the capacitor electrode 5C in the fifth layer through the via holes 18*d*, 18*g*, 18*j*, and 18*l*. The capacitor electrode 5C is electrically connected with the ground electrode 6C via the via hole 18*n*.

The electrodes 6A and 6B on the bottom of the multilayer substrate 30 are electrically connected with an input terminal 31 and an output terminal 32 that are disposed on the case 8. The ground electrode 6C is electrically connected with a ground electrode 33' that is provided on the magnetic metal plate molded onto the case 8. The ground electrode 33' is electrically connected with a ground terminal 33 that projects outward from the case 8.

The multilayer substrate 30 is typically produced in the form of a motherboard, although this is not shown. The motherboard is folded along half-cut grooves that are provided in the motherboard at predetermined pitches, or the motherboard is cut by a dicer, a laser, or other suitable method so as to design a desired size of the multilayer substrate 30.

Figure 4:
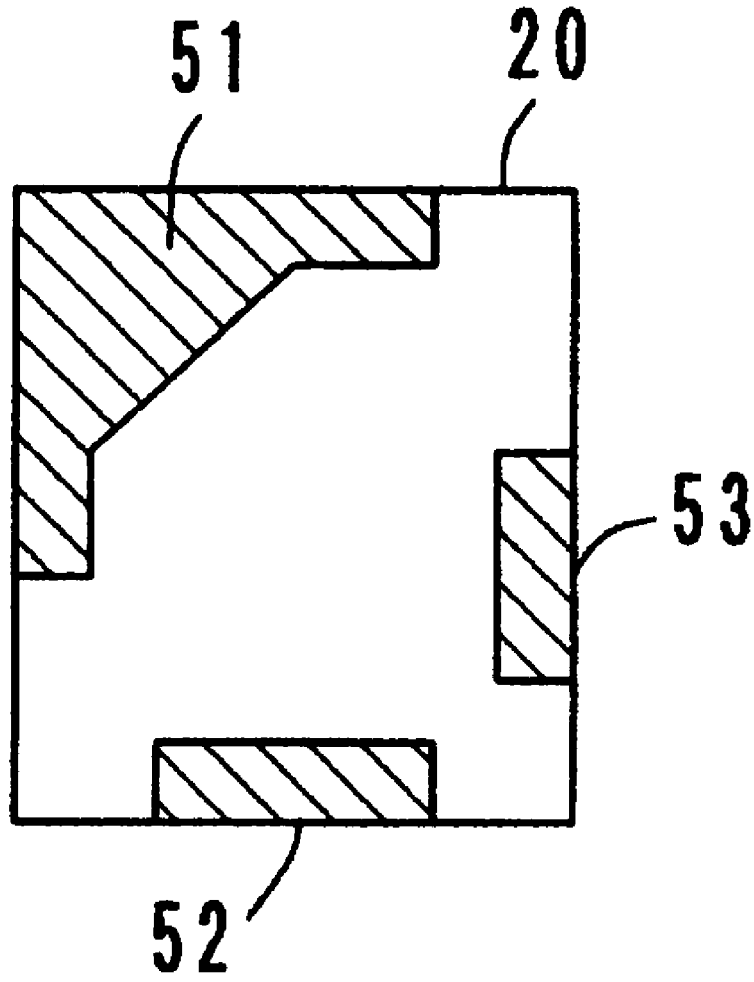
FIG. 4 is a bottom view of a ferrite member according to the first preferred embodiment of the present invention.

As shown in FIG. 4, the electrodes 51, 52, and 53 are provided on the bottom surface of the ferrite member 20. As shown in FIG. 5, the electrode 51 is electrically connected with the electrodes 1B and 1B' on the multilayer substrate 30, and the electrodes 52 and 53 are electrically connected with the electrodes 1A and 1C, respectively. One end of the center electrode 21 is electrically connected with the electrode 1A, and the other end is electrically connected with the electrode 1B. One end of the center electrode 22 is electrically connected with the electrode 1B', and the other end is electrically connected with the electrode 1C.

FIG. 6 is an equivalent circuit diagram of the isolator of the first preferred embodiment including the electrically connected elements described above. One end of the first center electrode 21 is electrically connected with an input port P1, and the other end is electrically connected with an output port P2. One end of the second center electrode 22 is electrically connected with the output port P2, and the other end is electrically connected with a ground port P3.

The first matching capacitor C1 is electrically connected between the input port P1 and the output port P2. The second matching capacitor C2 is electrically connected between the output port P2 and the ground port P3. The resistor R is electrically connected between the input port P1 and the output port P2.

The first matching capacitor C1 is defined by the capacitor electrodes 2B and 3A that face each other with the dielectric sheet 42 therebetween, and the capacitor electrodes 3A and 4B that face each other with the dielectric sheet 43 therebetween. The second matching capacitor C2 is defined by the capacitor electrodes 4B and 5C that face each other with the dielectric sheet 44 therebetween.

In the two-port isolator having the equivalent circuit shown in FIG. 6, when a signal propagates from the input port P1 to the output port P2, a resonance circuit including the inductor L1 (i.e., the center electrode 21) and the capacitor C1 is not resonated. Thus, the insertion loss is greatly reduced.

As described above, the insertion loss of the two-port isolator is more severely affected by the Q factor of the second matching capacitor C2 than by the Q factor of the first matching capacitor C1. In the first preferred embodiment, therefore, only the dielectric sheet 44 that defines the second matching capacitor C2 is made of a high-Q dielectric material such that the Q factor of the second matching capacitor C2 is greater than the Q factor of the first matching capacitor C1, thus reducing the insertion loss. The remaining sheets, i.e., the dielectric sheets 41 to 43 and 45, are made of a lower-Q dielectric material than the dielectric sheet 44.

Typically, all dielectric sheets 41 to 45 are preferably made of a high-Q dielectric material, whereas, in the first preferred embodiment, the dielectric sheets 41 to 43 and 45 are preferably made of a low-Q dielectric material, thus reducing the manufacturing cost of the multilayer substrate 30. The matching capacitors C1 and C2 are provided in the single multilayer substrate 30, thus reducing the size and the thickness.

Commercially available materials, which are suitable for dielectric ceramic sheets, have a Q-f value of about 50 GHz to about 10000 GHz. Moreover, manufacturing of dielectric materials whose Q-f value is about 2000 GHz or higher is achieved by the use of high-purity starting material or a high-precision manufacturing process. Accordingly, the dielectric sheets 42 and 43, which define the first matching capacitor C1, and the dielectric sheets 41 and 45 are preferably made of a dielectric material having a Q-f value of about 50 GHz to about 2000 GHz, while only the dielectric sheet 44 that defines the second matching capacitor C2 is made of a dielectric material having a Q-f value of about 2000 GHz to about 10000 GHz.

In the frequency band at which the isolator of the first preferred embodiment operates, the Q factor of the first matching capacitor C1 is about 5 to about 50, and the Q factor of the second matching capacitor C2 is about 50 to about 500. Thus, the higher the Q factor of the second matching capacitor C2 as compared to the first matching capacitor C1, the better.

Data of the isolator obtained through an experiment by the inventor of the present invention are as follows:

the operating frequency (center frequency) of the isolator is about 1441 MHz;

the first matching capacitor C1 has a capacitance of about 8.5 pF and a Q factor of about 30, and includes dielectric sheets having a composition of $CaO—Al_2O_3—SiO_2—B_2O_3$ ceramic and having a thickness of about 25 $\mu$m; and the second matching capacitor C2 has a capacitance of about 10.5 pF and a Q factor of about 200, and includes dielectric sheets having a composition of $BaO—Nd_2O_3—TiO_2—SiO_2—B_2O_3$ ceramic and having a thickness of about 25 $\mu$m.

Generally, the higher the relative dielectric constant of dielectric materials, the higher the dielectric loss. In order to reduce the insertion loss of the isolator, the dielectric sheet that defines the first matching capacitor C1 is preferably made of a high-relative-dielectric-constant dielectric material. However, it is undesirable that the dielectric sheet that define the second matching capacitor C2 be made of such a dielectric material. The dielectric sheet for the first matching capacitor C1, which is preferably made of a high-relative-dielectric-constant dielectric material, contributes to small capacitor electrodes that define the matching capacitor C1 and fewer dielectric sheets that define the matching capacitor C1. A compact and low-cost isolator is therefore obtained.

When the multilayer substrate 30 is not housed in the case 8, the electrodes 1B and 1B' on the top surface of the multilayer substrate 30 are not electrically connected, and the matching capacitor C1 and the resistor film 75 are not connected in parallel. In this state, the matching capacitor C1 is measured with high precision.

Second Preferred Embodiment

A two-port isolator according to a second preferred embodiment of the present invention will be described with reference to FIG. 7. The isolator of the second preferred embodiment preferably has basically the same structure and functions as those of the two-port lumped-constant-type isolator of the first preferred embodiment. Particularly, in the second preferred embodiment, as shown in FIG. 7, the via holes 18*b* to 18*d*, 18*f*, 18*g*, 18*i* to 18*l*, 18*n*, and 18*o* connected to the electrodes 4B and 5C, which define the second matching capacitor C2, are larger than the via holes 18*a*, 18*e*, 18*h*, 18*m*, and 18*p* connected to the electrodes 2B, 3A, and 4B, which define the first matching capacitor C1.

Due to the manufacturing technology, the via hole diameter suitable for formation in a dielectric sheet is about 0.05 to about 0.5 mm. Thus, preferably, the small via holes are about 0.05 to about 0.3 mm in diameter, and the large via holes are about 0.3 to about 0.5 mm in diameter.

The larger the via hole connected to the capacitor electrode, the lower the conductor loss of the via hole, resulting in a high-Q matching capacitor. However, in order to prevent an electrical short circuit between a via hole and a capacitor electrode provided on the dielectric sheet with this via hole therethrough, at least a certain clearance is required between the electrode and the via hole. Thus, if the area of the via hole increases in order to realize a high-Q matching capacitor, the space for the capacitor electrode decreases. It is therefore necessary to increase the number of dielectric sheets or increase the size of the multilayer substrate 30 in order to obtain the desired matching capacitance, thus making it difficult to obtain a size-reduced and low-cost isolator.

The two-port isolator has a feature that the insertion loss is more severely affected by the Q factor of the second matching capacitor than by the Q factor of the first matching capacitor. In the second preferred embodiment, therefore, the area of the via holes connected to the electrodes for the first matching capacitor is reduced, thus reducing the Q factor of the first matching capacitor. In this case, the insertion loss is not substantially deteriorated. On the other hand, the area of the via holes connected to the electrodes for the second matching capacitor increases, thus increasing the Q factor of the second matching capacitor, which leads to low insertion loss.

Since the area of the via holes connected to the electrodes for the first matching capacitor is small, large capacitor electrodes 4B and 5C are provided in the dielectric sheets 44 and 45 with the via holes 18*m* and 18*p* therethrough. Thus, the required matching capacitance is obtained without increasing the number of dielectric sheets or increasing the size of the multilayer substrate 30.

The remaining structure of the second preferred embodiment is similar to that of the first preferred embodiment, and the advantages of the second preferred embodiment are similar to those of the first preferred embodiment.

Third Preferred Embodiment

Figure 8A:
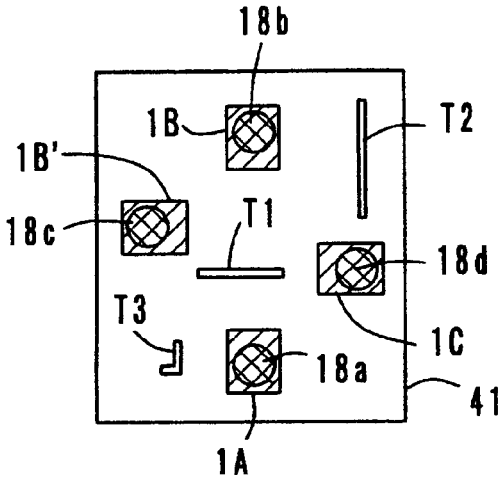
FIGS. 8A to 8F are plan views of layers of a multilayer substrate of a two-port isolator according to a third preferred embodiment of the present invention.
Figure 8D:
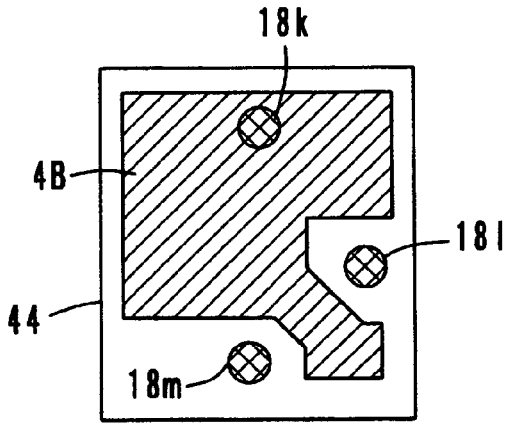
Figure 8B:
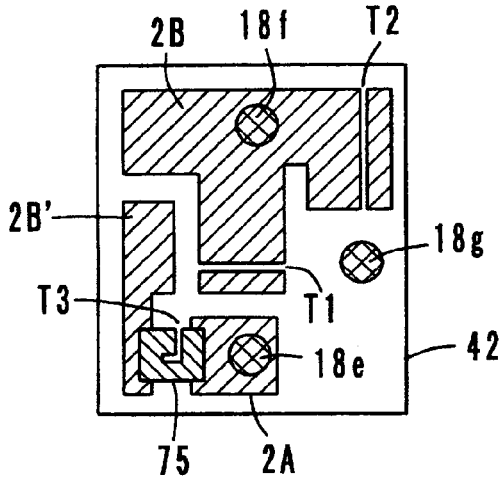
Figure 8E:
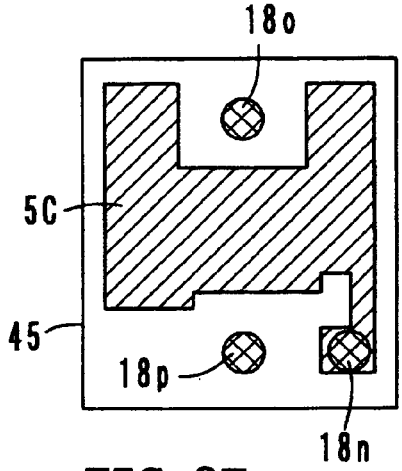
Figure 8C:
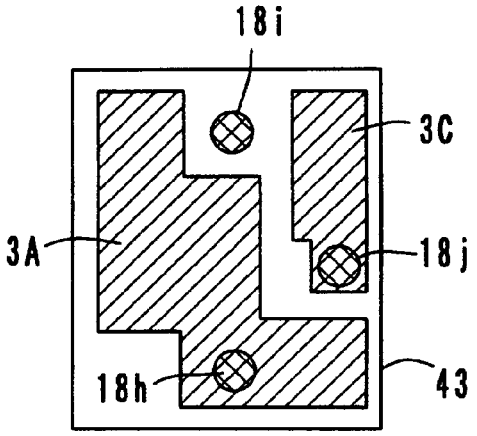
Figure 8F:
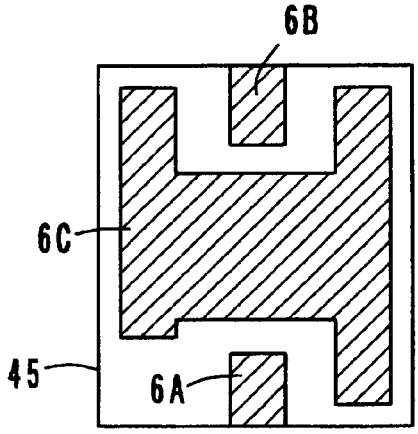
Figure 9:
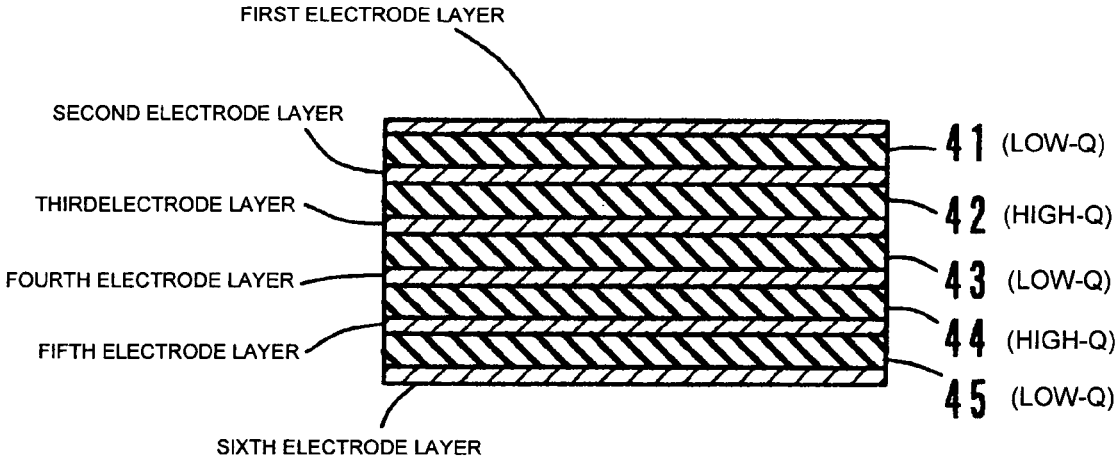
FIG. 9 is a schematic cross-sectional view of the multilayer substrate shown in FIG. 8.

A two-port isolator of a third preferred embodiment of the present invention will be described with reference to FIGS. 8 and 9. The isolator of the third preferred embodiment has basically the same structure and functions as those of the two-port lumped-constant-type isolator of the first preferred embodiment. Particularly, in the third preferred embodiment, as shown in FIG. 8, the first matching capacitor C1 includes the capacitor electrodes 2B and 3A that face each other with the dielectric sheet 42 disposed therebetween, and the capacitor electrodes 3A and 4B that face each other with the dielectric sheet 43 therebetween, and the second matching capacitor C2 includes the capacitor electrodes 2B and 3C that face each other with the dielectric sheet 42 therebetween, the capacitor electrodes 3C and 4B that face each other with the dielectric sheet 43 therebetween, and the capacitor electrodes 4B and 5C that face each other with the dielectric sheet 44 therebetween.

The dielectric sheets 42 and 44, which define the second matching capacitor C2, are preferably made of a high-Q dielectric material, and the remaining sheets, i.e., the dielectric sheets 41, 43, and 45, are preferably made of a dielectric material of lower Q than the dielectric sheets 42 and 44.

The second electrode 2B is trimmed by laser-trimming or sand-blasting from the top dielectric sheet 41 (see FIG. 8B), and the resistor film 75 is also trimmed so as to adjust the capacitances of the matching capacitors C1 and C2. In FIGS. 8A and 8B, the trimmed portions are represented by T1, T2, and T3.

In the manufacturing process of the multilayer substrate 30, due to electrode pattern errors, variations in the thickness of dielectric sheets, etc., defective products that do not meet a required matching capacitance range are occasionally produced. Trimming of the capacitor electrodes enables the capacitances of the matching capacitors C1 and C2 to be adjusted within the required range, thus preventing the occurrence of defects.

In the third preferred embodiment, therefore, the capacitor electrode 2B to be trimmed is formed in a shallow layer (i.e., the second layer) shared between the first matching capacitor C1 and the second matching capacitor C2, thus facilitating the trimming processing. If the capacitor electrode to be trimmed is formed in a deep layer, a high-power laser oscillator is required or the trimming time must be increased, thus increasing the cost.

Moreover, the dielectric sheet 42 in the second layer shared with the second matching capacitor C2 is made of a high-Q dielectric material.

Fourth Preferred Embodiment

Figure 10:
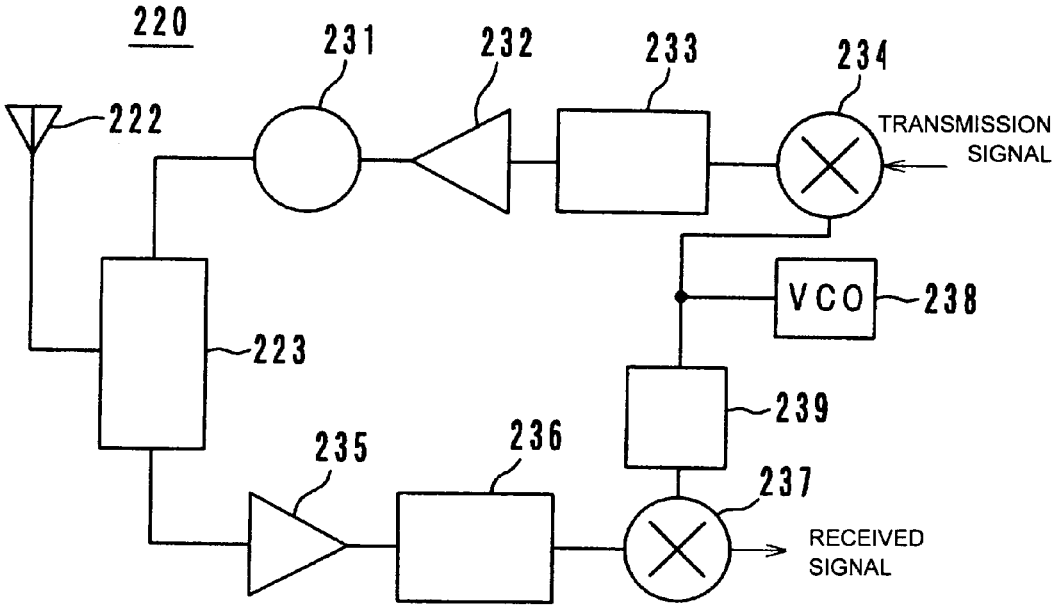
FIG. 10 is a block diagram of an electrical circuit of a communication device according to another preferred embodiment of the present invention.

A communication device according to a fourth preferred embodiment of the present invention will be described with reference to FIG. 10 in the context of, for example, a cellular telephone. FIG. 10 shows an electrical circuit of the RF portion of a cellular telephone 220. The cellular telephone 220 preferably includes an antenna device 222, a duplexer 223, a transmitter isolator 231, a transmitter amplifier 232, a transmitter interstage bandpass filter 233, a transmitter mixer 234, a receiver amplifier 235, a receiver interstage bandpass filter 236, a receiver mixer 237, a voltage controlled oscillator (VCO) 238, and a local bandpass filter 239.

The transmitter isolator 231 may be the two-port lumped-constant-type isolator described above with reference to the preferred embodiments. Thus, the cellular telephone including such a compact and low-cost isolator is compact and low-cost.

Other Preferred Embodiments

The present invention is not limited to the two-port isolator according to the foregoing preferred embodiments, and it is to be understood that a variety of modifications may be made without departing from the spirit and scope of the invention.

What is claimed is:

1. A two-port isolator comprising:

a permanent magnet;

a microwave ferrite member to which a DC magnetic field is applied by the permanent magnet;

a first center electrode disposed on a surface of the microwave ferrite member or disposed in the microwave ferrite member, the first center electrode having a first end electrically connected with an input port and a second end electrically connected with an output port;

a second center electrode disposed on the surface of the microwave ferrite member or disposed in the microwave ferrite member so as to intersect with the first center electrode with electrical isolation therebetween, the second center electrode having a first end electrically connected with the output port and a second end electrically connected with a ground;

a first capacitor electrically connected between the input port and the output port;

a second capacitor electrically connected between the output port and ground; and a resistor electrically connected between the input port and the output port; wherein the second capacitor has a Q factor that is substantially higher than the first capacitor.

2. The two-port isolator according to claim 1, wherein the first and second capacitors include dielectric materials such that the dielectric material of the second capacitor has a higher Q factor than the dielectric material of the first capacitor.

3. The two-port isolator according to claim 1, wherein the first and second capacitors are included in a single laminated substrate.

4. The two-port isolator according to claim 1, wherein the first capacitor includes a first electrode and a second electrode that face each other with a first dielectric sheet therebetween, and the second electrode and a third electrode that face each other with a second dielectric sheet therebetween;

the second capacitor includes the third electrode and a fourth electrode that face each other with a third dielectric sheet therebetween; and the third dielectric sheet has a Q factor that is higher than the first and second dielectric sheets.

5. The two-port isolator according to claim 1, wherein the first capacitor includes a first electrode and a second electrode that face each other with a first dielectric sheet therebetween, and the second electrode and a third electrode that face each other with a second dielectric sheet therebetween;

the second capacitor includes the first electrode and a fourth electrode that face each other with the first dielectric sheet therebetween, the fourth electrode and the third electrode that face each other with the second dielectric sheet therebetween, and the third electrode and a fifth electrode that face each other with a third dielectric sheet therebetween; and the first and third dielectric sheets have a Q factor that is higher than the second dielectric sheet.

6. A communication device comprising the two-port isolator according to claim 1.

7. The two-port isolator according to claim 1, wherein said microwave ferrite member is substantially rectangular.

8. The two-port isolator according to claim 1, wherein said resistor includes a resistor film made of at least one of cermet, carbon and ruthenium.

9. The two-port isolator according to claim 1, wherein the Q factor of the first capacitor is in a range of about 5 to about 50, and the Q factor of the second capacitor is in a range of about 50 to about 500.

10. The two-port isolator according to claim 1, wherein a via hole connected with electrodes that define the second capacitor is larger than a via hole connected with electrodes that define the first capacitor.

11. The two-port isolator according to claim 10, wherein the via hole connected with electrodes that define the second capacitor has a diameter in a range of about 0.3 mm to about 0.5 mm, and the via hole connected with electrodes that define the first capacitor has a diameter in a range of about 0.05 mm to about 0.3 mm.

12. The two-port isolator according to claim 1, wherein further comprising a housing including a cap and a case that are made of a ferromagnetic material.

13. The two-port isolator according to claim 12, wherein the cap and the case are plated with Ag or Cu.

* * * * *